US005839707A

United States Patent [19]

Barringer

[11] Patent Number: 5,839,707

[45] Date of Patent: Nov. 24, 1998

[54] TRENCH SHIELD STACKING DEVICE

[75] Inventor: Luther Bradford Barringer, Richfield, N.C.

[73] Assignee: Efficiency Production, Inc., Mason, Mich.

[21] Appl. No.: 621,125

[22] Filed: Mar. 22, 1996

[51] Int. Cl.[6] ..... A47B 96/06

[52] U.S. Cl. ..... 248/214; 403/389; 403/391; 405/282

[58] Field of Search ..... 248/227.4, 219.4, 248/251, 261; 211/194, 188; 52/562, 426, 427, 428, 442; 403/397, 391, 389, 396, 237, 234, 232.1; 405/282, 283, 272, 303

[56] References Cited

U.S. PATENT DOCUMENTS

| | | | |
|---|---|---|---|
| 2,088,890 | 8/1937 | Winby et al. | 403/389 X |
| 5,162,615 | 11/1992 | Schrader et al. | 403/391 X |

FOREIGN PATENT DOCUMENTS

| | | | |
|---|---|---|---|
| 1012892 | 4/1952 | France | 403/391 |

*Primary Examiner*—Ramon O. Ramirez
*Assistant Examiner*—Long Dinh Phan
*Attorney, Agent, or Firm*—Miller, Morriss & Pappas

[57] ABSTRACT

A trench shield stacking bracket provided for facilitating the stacking of trench shields. The trench shield stacking bracket comprises an elongate hollow body frame which defines a pair of spaced apart trench shield spreader bar engaging Wall having upper and lower portions. The trench shield spreader bar engaging walls define upwardly opening trench shield spreader bar engaging slots in the upper portions thereof. The trench shield spreader bar engaging walls define downwardly opening trench shield spreader bar engaging slots in the lower portions thereof in opposed spaced apart register with the upwardly opening trench shield spreader bar engaging slots. Means are provided to selectively retain trench shield spreader bars selectively positioned within the upper and lower spreader bar engaging slots-during trench shield stacking operations. Stabilizer plate means are provided on one of the trench shield spreader engaging walls so as to extend outwardly from the wall intermediate the upper and lower spreader bar engaging slots so as to selectively engage the upper edge of a trench shield wall being stacked. A modified embodiment of the trench shield stacking bracket is provided with a centrally positioned horizontally oriented trench shield wall engaging flange extending outwardly therefrom so as to engage the upper edge of a trench shield wall.

2 Claims, 7 Drawing Sheets

TRENCH SHIELD STACKING DEVICE

This invention relates to trench shield stacking devices and systems which are selectively attached to trench shields so as to allow them to be stacked quickly and accurately so as to reduce cycle time.

Further, this invention relates to one embodiment of the stacking brackets which are selectively attached to trench shields spreader pipes so as to permit the easy, fast, safe and accurate stacking of trench shields. The use of trench stacking brackets which are selectively attached to trench shield spreaders provides greater versatility as it can be used with greater variety of trench shield sidewall widths.

This invention also relates to another embodiment of the stacking brackets which are selectively attached to trench shield sidewalls.

This invention also relates to trench shield stacking brackets which are easily and quickly installed on trench shields so as to facilitate the stacking of the trench shields.

The known prior art stacking devices primarily consist of sockets which are fixedly positioned at the upper corners of the trench shields so as to matingly engage with downwardly extending positioning pins fixedly positioned at the lower corners. Such sockets and mating pins are quickly damaged in use and rendered inoperative. Further, even if the sockets and pins are not damaged, the excavator operator finds it difficult to guide positioning pins into mating engagement within the sockets.

A need has therefore existed for trench stacking devices and systems which permit the fast, efficient, inexpensive and safe stacking and unstacking of trench shields.

It is, therefore, an object of this invention to provide trench shield stacking brackets and systems which expedite the stacking and unstacking of trench shields in a fast, efficient, inexpensive and safe manner.

Further, this invention greatly facilitates and expedites the stacking of trench shields.

Other objects and advantages found in the construction and use of this invention will be apparent from a consideration of the description, the accompanying drawings and the appended claims.

IN THE DRAWINGS

DESCRIPTION

Figure 1:
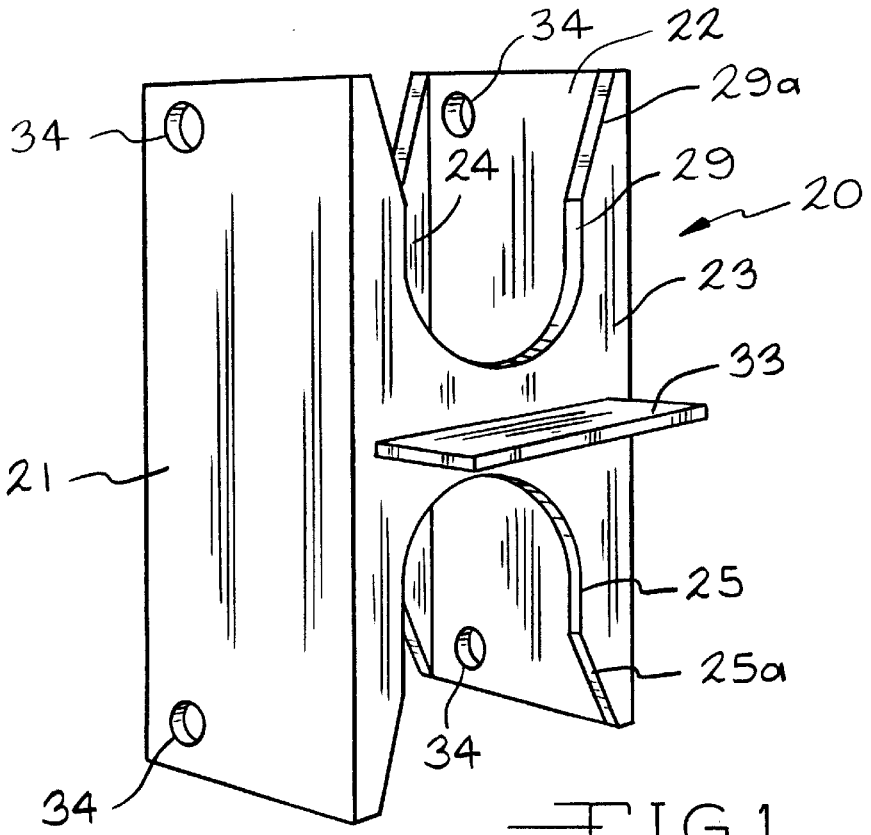
FIG. 1 is a front perspective view of an embodiment of the trench shield stacking bracket which is adapted to engage the trench shield spreaders.
Figure 2:
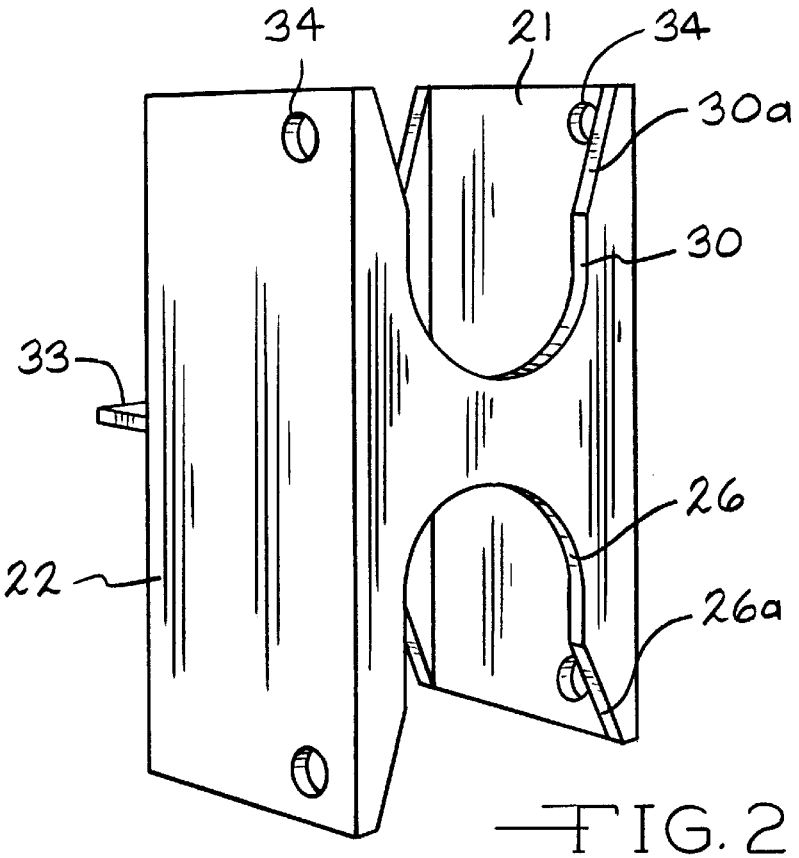
FIG. 2 is a rear perspective view thereof.
Figure 3:
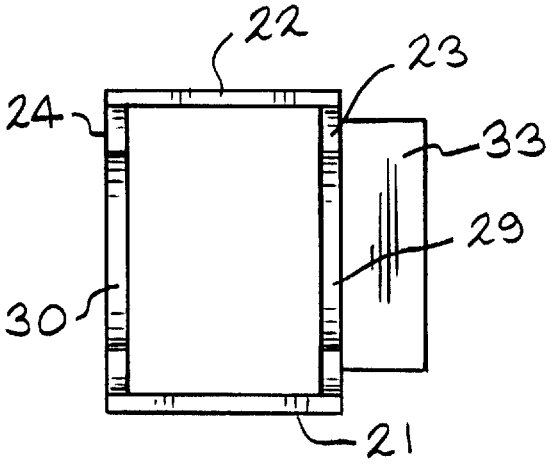
FIG. 3 is a top view thereof.
Figure 4:
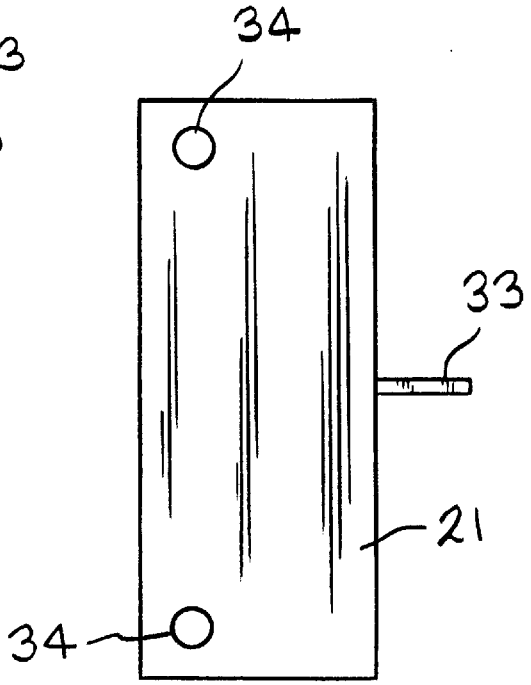
FIG. 4 is a side view thereof.
Figure 5:
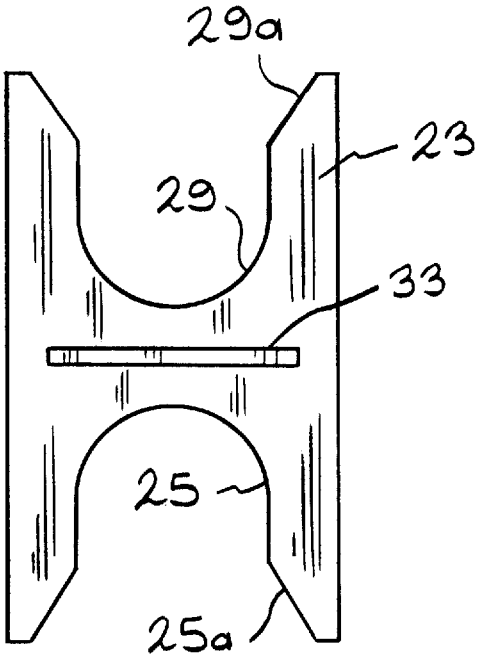
FIG. 5 is a front view thereof.
Figure 6:
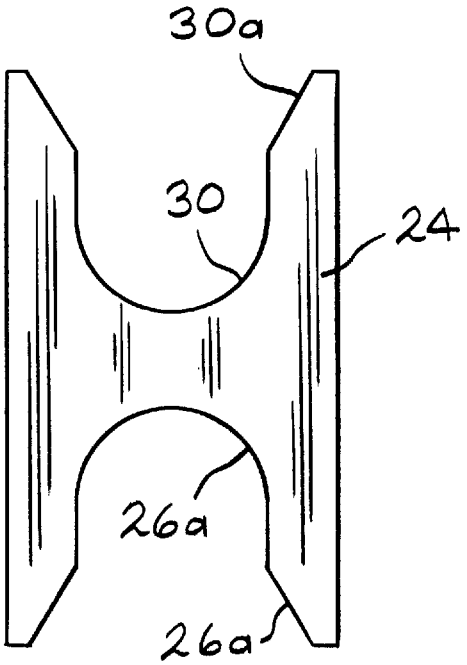
FIG. 6 is a rear view thereof.

As shown in the front perspective view of FIG. 1, a trench shield stacking bracket 20 is provided with an elongate vertically oriented hollow body frame 20. The hollow body frame is comprised of two spaced-apart side walls, 21 and 22, respectively.

The hollow body frame is comprised of a pair of spaced-apart trench shield spreader bar engaging walls, 23 and 24, respectively.

The lower portions of the walls 23 and 24 are provided with downwardly opening spreader bar receiving slots 25 and 26, respectively which are in spaced-apart register with each other so as to form a cradle to matingly engage the spreader bar 27 of the trench shield 28 upon which the trench shield stacking bracket is mounted.

The upper portions of the spaced-apart spreader bar engaging walls, 23 and 24, respectively are provided with upwardly opening spreader bar receiving slots 29 and 30, respectively which are in spaced-apart register with each other so as to form a cradle to matingly engage the spreader bar 31 of the trench shield 32 being stacked. It should be noted that the spreader bars and trench shield discussed herein are not a part of the invention.

As shown generally in the drawings, the downwardly opening spreader bar receiving slots 25 and 26, respectively are in opposed spaced-apart register with the upwardly opening spreader bar receiving slots 29 and 30.

The spreader bar receiving slots 25, 26, 29, and 30 are flared outwardly near their openings as shown at 25*a*, 26*a*, 29*a* and 30*a* to facilitate the mating engagement of the trench shield spreader bars with the spreader bar slots, particularly during the heretofor delicate stacking operation of one trench shield upon another.

A centrally positioned horizontally oriented flat stabilizer plate 33 is provided so as to extend outwardly from the wall 23 of the stacking bracket body frame 20 so as to stabilizingly engage the upper wall surface of the trench shield 28 upon which it is mounted.

Spreader bar retainer pin receiving holes 34 are provided through the upper and lower portions of the side walls 21 and 22.

Figure 7:
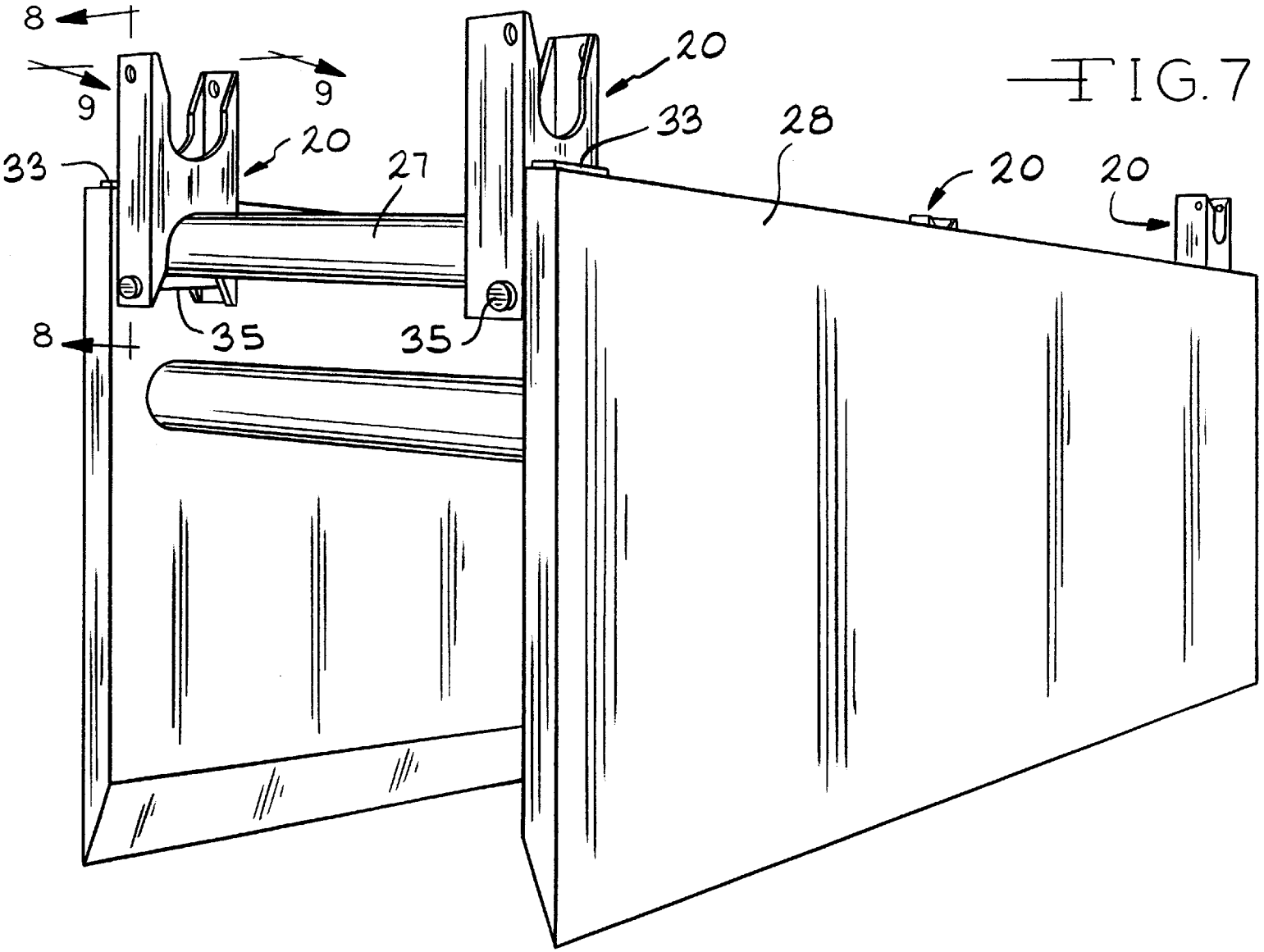
FIG. 7 is a perspective view showing the trench shield stacking brackets mounted on the trench shield spreaders.

The unique design of the trench shield stacking brackets permits quick installation of the stacking brackets on the trench shield. As shown in FIG. 7, four stacking brackets 20 are located in their operational use position at each corner of the trench wall 28.

Figure 8:
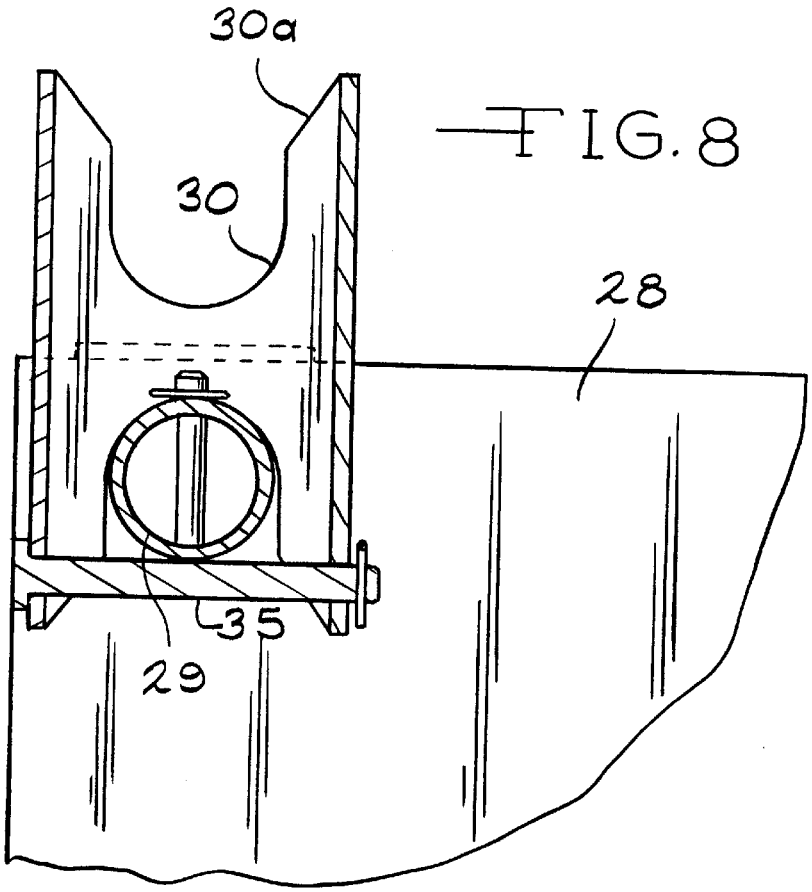
FIG. 8 is a cross-sectional view taken on line 8—8 of FIG. 7.
Figure 9:
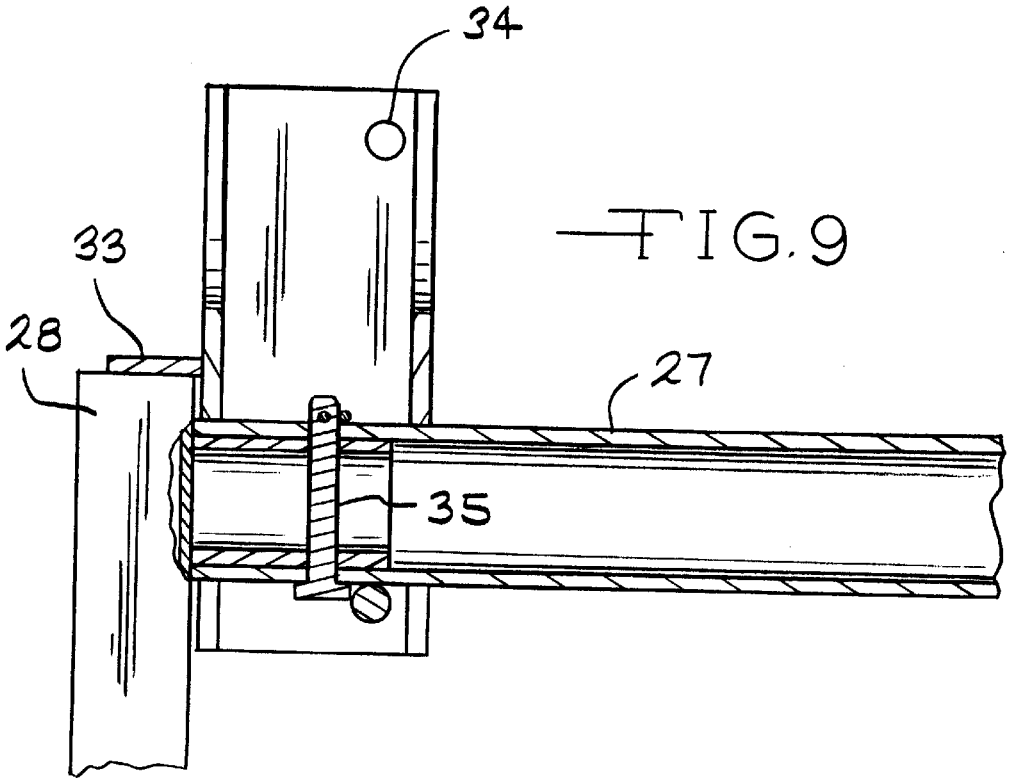
FIG. 9 is a cross-sectional view taken on line 9—9 of FIG. 7.

As shown on FIG. 7 and in the cross-sectional views of FIG. 8 taken on line 8—8 of FIG. 7 and FIG. 9 taken on line 9—9 of FIG. 7, a retainer pin 35 is positioned through the corresponding retaining pin receiving holes 34 so as to retain the spreader bar 27 in its corresponding slots. The retainer pin 35 is secured in its operational use position by a cotter pin 36 (or other suitable retainer member) which is provided on the end of the retainer pin 35.

Figure 10:
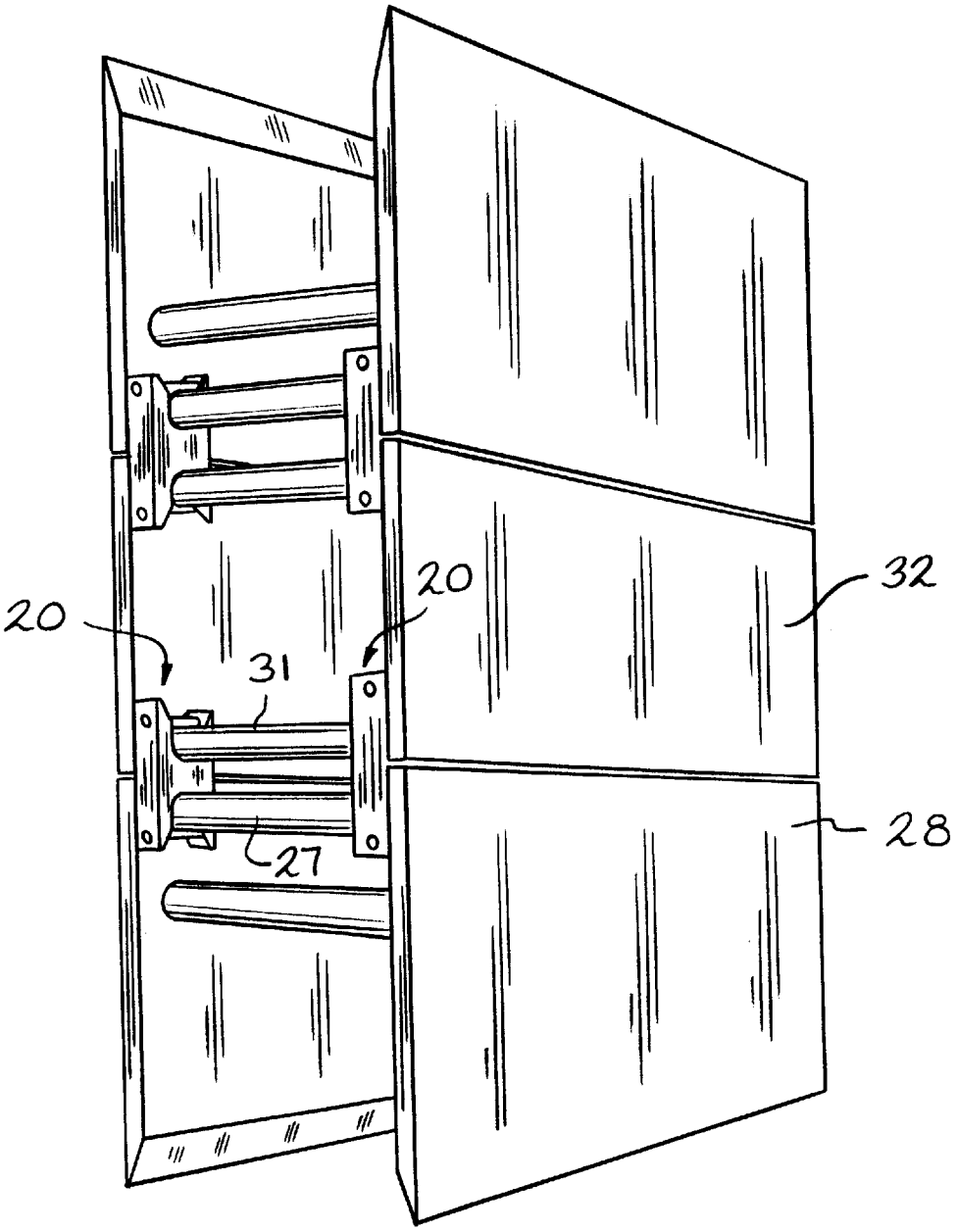
FIG. 10 is a perspective of three trench shields stacked together by use of the spreader-mounted trench shield stacking brackets.

As shown in FIG. 10, three trench shields have been easily and quickly stacked by use of the trench shield stacking brackets 20 which are solely supported by the trench shields being stacked. There is no use of pin and sockets permanently affixed to the trench shields which have been unsatisfactory and easily damaged.

Figure 11:
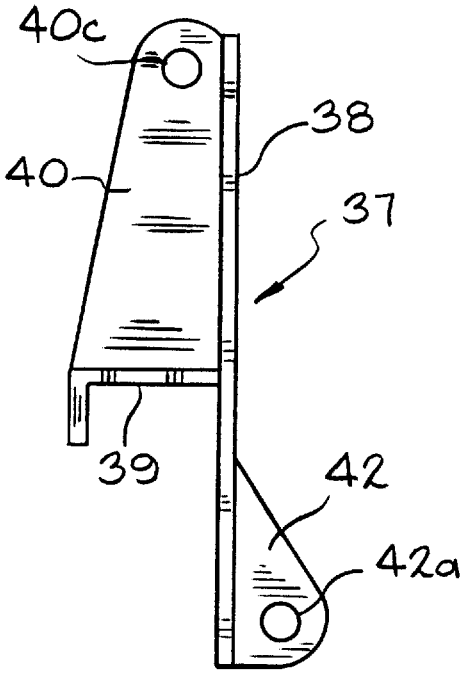
FIG. 11 is a side view of an embodiment of the trench shield stacking bracket which is adapted to engage the trench shield walls.

The left side view of FIG. 11 shows a modification of the invention whereby an easily installed trench shield wall supported stacking bracket 37 is provided with a vertically oriented spreader bar support member 38 having centrally positioned outwardly extending horizontally oriented flange member 39 which is adapted to matingly engage the upper edge of a trench wall.

A pair of parallel spaced-apart retainer pin support flanges 40 and 41, respectively, are provided so as to extend vertically upward from the flange member 39 along the edges of the vertically oriented spreader support member 38. Retainer pins engaging holes 40*a* and 41*a* are provided in the upper portion of the retainer pin support flanges 40 and 41.

The lower portion of the vertical spreader support member 38 is adapted to extend downwardly in contact with the inside surface of the trench wall upon which the stacking member 37 is mounted.

A pair of spaced-apart inwardly extending vertically oriented retainer pin support flanges 42 and 43 are provided along the lower edge of the spreader support member. Retainer pin engaging holes 42*a* and 43*a* are provided in the lower portion of the retainer pin support flanges 42 and 43.

Figure 12:
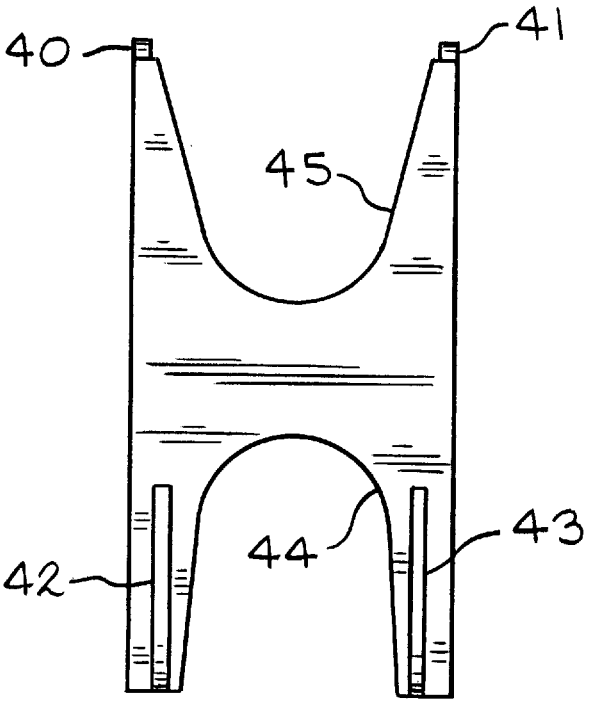
FIG. 12 is a front view thereof.
Figure 13:
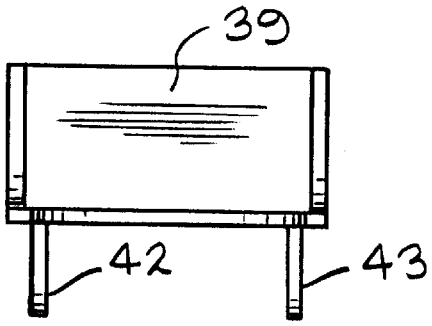
FIG. 13 is a top view thereof.
Figure 14:
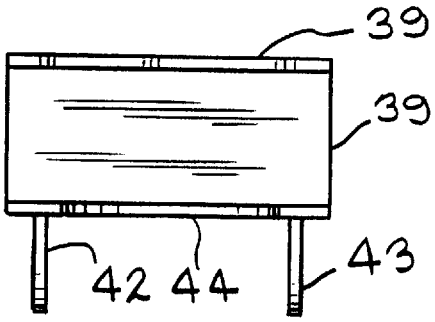
FIG. 14 is a bottom view thereof.
Figure 15:
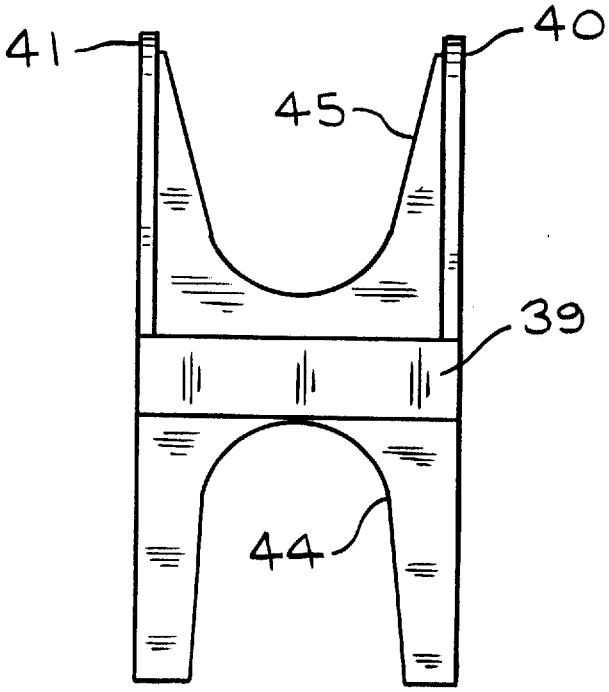
FIG. 15 is a rear view thereof.

As shown in the front and rear elevation views of FIGS. 12 and 13, respectively, a downwardly opening spreader bar engaging slot 44 is provided in the lower portion of the spreader support member 38 so as to extend between the retainer pin support flanges 42 and 43.

An upwardly opening spreader engaging slot 45 is provided in the upper portion of the spreader support member 38 so as to extend between the retainer pin flanges 40 and 41. The downwardly opening spreader engaging slot 44 is in substantially opposed register with the upwardly opening spreader engaging slot 45.

Figure 16:
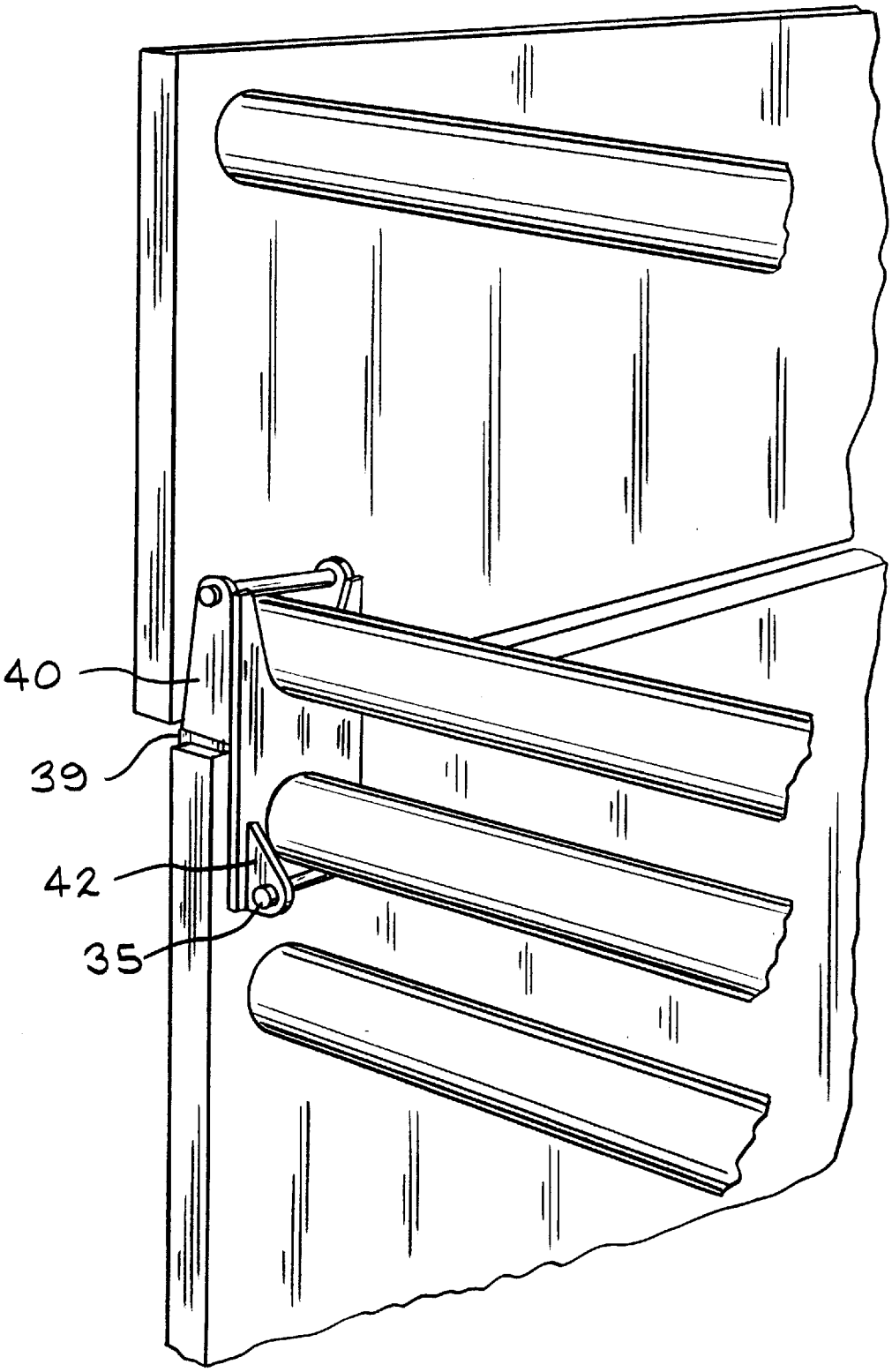
FIG. 16 is a perspective view showing the trench shield bracket positioned on a trench shield upper wall surface in stacking position.

The modified stacking bracket 37 is shown in FIG. 16 in its iperative use position in engagement with the spreader bars of the trench shield in their stacked position.

In summary, the trench shield stacking bracket is adapted to safely, quickly and easily facilitate the stacking of trench shields. The elongate hollow body frame defines a pair of spaces apart trench shield spreader bar engaging walls. The trench shield spreader bar engaging walls define upwardly opening trench shield spreader bar engaging slots in the upper portions thereof. The trench shield spreader bar engaging walls define downwardly opening trench shield spreader bar engaging slots in the lower portions thereof in opposed spaced-apart register with the upwardly opening trench shield spreader bar engaging slots. Means are provided to selectively retain the trench shield spreader bars which are selectively positioned within the slots during the trench shield stacking operations. Stabilizer plate means are provided on one of the trench shield spreader bar engaging walls. The stabilizer plate means extend outwardly from the bar engaging wall intermediate the upper and lower spreader bar engaging slots so as to selectively engage the upper edge of the trench shield wall.

A modified trench shield stacking bracket is provided which is adapted to be selectively mounted on a trench shield wall. A vertical oriented trench shield spreader bar support member is provided with a centrally positioned horizontally oriented trench shield wall engaging flange extending outwardly therefrom so as to engage the upper edge of a trench shield wall. The flange is adapted to position the spreader bar support member with the lower portion thereof extending downwardly along the inside surface of the trench shield wall and the upper portion thereof extending upwardly above the upper edge of the trench shield wall.

A downwardly opening trench shield spreader bar engaging slot is provide in the lower portion of the spreader bar support member.

An upwardly opening trench shield spreader bar engaging slot is provided in the upper portion of the spreader bar support member. The upwardly opening trench shield spreader bar engaging slot is in opposed spaced-apart register with the downwardly opening trench shield spreader bar engaging slot provided in the lower portion of the spreader bar support member.

A pair of spaced-apart upwardly extending retainer pin support flanges are provided which extend upwardly from the trench wall engaging flange along the edges of the spreader bar support member so as to position the upwardly opening trench shield spreader bar engaging slot therebetween.

A pair of downwardly extending spaced-apart retainer pin support flanges are positioned on the lower portion of the spreader bar support member so as to position the downwardly opening trench shield spreader bar engaging slot therebetween.

Retainer pin means are provided in association with the retainer pin flanges so as to selectively retain trench shield spreader bars within the spreader bar engaging slots during the trench shield stacking operation.

Various other modifications of the invention may be made without departing from the principle thereof. Each of the modifications is to be considered as included in the scope of the hereinafter appended claims, unless these clams, by their language, expressly provide otherwise.

I claim:

1. In a trench shield stacking bracket adapted to safely, quickly and easily facilitate the stacking of trench shields having an upper edge comprising:

(a) an elongate hollow body frame, said body frame defining a pair of spaced apart trench shield spreader bar engaging walls having upper and lower portions, said trench shield spreader bar engaging walls defining upwardly opening trench shield spreader bar engaging slots in the upper portions thereof, said trench shield spreader bar engaging walls defining downwardly opening trench shield spreader bar engaging slots in the lower portions thereof in opposed spaced-apart register with said upwardly opening trench shield spreader bar engaging slots;

(b) means to selectively retain trench shield spreader bars selectively positioned within said slots during trench shield stacking operations; and (c) stabilizer plate means provided on one of said trench shield spreader bar engaging walls, said stabilizer plate means extending outwardly from said wall intermediate said upper and lower spreader bar engaging slots so as being adapted to selectively engage the upper edge of a trench shield wall.

2. In a modified trench shield stacking bracket adapted to be selectively mounted on a upper edge of a trench shield wall comprising:

(a) a vertically oriented trench shield spreader bar support member having upper and lower portions, said trench shield support member having a centrally positioned horizontally oriented trench shield wall engaging flange extending outwardly therefrom so as being adapted to engage the upper edge of a trench shield wall, said flange adapted to position said spreader bar support member with the lower portion thereof extending downwardly along the inside surface of the trench shield wall and the upper portion thereof extending upwardly above the upper edge of the trench shield wall;

(b) a downwardly opening trench shield spreader bar engaging slot provided in the lower portion of said spreader bar support;

(c) an upwardly opening trench shield spreader bar engaging slot provided in the upper portion of said spreader bar support member, said upwardly opening trench shield spreader bar engaging slot being in opposed spaced-apart register with said downwardly opening trench shield spreader bar engaging slot provided in the lower portion of said spreader bar support member;

(d) a pair of spaced-apart upwardly extending retainer pin support flanges extending upwardly from said trench wall engaging flange along the edges of said spreader bar support member so as to position said upwardly opening trench shield spreader bar engaging slot therebetween;

(e) a pair of downwardly extending spaced apart retainer pin support flanges positioned on the lower portion of said spreader bar support member so as to position said downwardly opening trench shield spreader bar engaging slot therebetween;

(f) retainer pin means provided in association with said retainer pin flanges adapted to selectively retain trench shield spreader bars within said spreader bar engaging slots during trench shield stacking operations.

* * * * *